US010906703B2

(12) United States Patent
Gormley

(10) Patent No.: US 10,906,703 B2
(45) Date of Patent: Feb. 2, 2021

(54) VESSEL CAP

(71) Applicant: GOBUBL LIMITED, London (GB)

(72) Inventor: Michael David Gormley, London (GB)

(73) Assignee: GOBUBL LIMITED, London (GB)

( * ) Notice: Subject to any disclaimer, the term of this patent is extended or adjusted under 35 U.S.C. 154(b) by 266 days.

(21) Appl. No.: 16/073,123

(22) PCT Filed: Jan. 26, 2017

(86) PCT No.: PCT/GB2017/050205
§ 371 (c)(1),
(2) Date: Jul. 26, 2018

(87) PCT Pub. No.: WO2017/129984
PCT Pub. Date: Aug. 3, 2017

(65) Prior Publication Data

US 2019/0039785 A1 Feb. 7, 2019

(30) Foreign Application Priority Data

Jan. 26, 2016 (GB) ..... 1601474.8
Dec. 8, 2016 (GB) ..... 1620937.1

(51) Int. Cl.
*B65D 39/00* (2006.01)
*B65D 81/20* (2006.01)
(Continued)

(52) U.S. Cl.
CPC ..... *B65D 39/0035* (2013.01); *B65D 45/06* (2013.01); *B65D 45/24* (2013.01);
(Continued)

(58) Field of Classification Search
CPC ..... B65D 81/2053; B65D 81/2076; B65D 45/06; B65D 45/24; B65D 51/24; B65D 51/1644; B65D 39/0035
(Continued)

(56) References Cited

U.S. PATENT DOCUMENTS 158,406 A * 1/1875 DeQuillfeldt ..... B65D 45/24 215/240
1,433,383 A * 10/1922 Klostermann ..... B65D 45/24 215/293
(Continued)

FOREIGN PATENT DOCUMENTS

CN 105156723 12/2015
EP 2 727 993 5/2014
(Continued)

OTHER PUBLICATIONS

International Search Report in PCT/GB2017/050205 dated Aug. 3, 2017.
(Continued)

*Primary Examiner* — Ernesto A Grano
(74) *Attorney, Agent, or Firm* — DLA Piper LLP (US)

(57) ABSTRACT

A vessel cap (100, 10) for exchanging gas in and pressuring a vessel headspace (30), the cap (100, 10) comprising a cap inlet (11), a seal (12) arranged to form a gas-tight seal on a vessel opening, a pressure reducing valve, a gas inlet port (25) arranged to allow incoming gas into the vessel headspace (30), a gas outlet port (31) arranged to allow outgoing gas to escape from the vessel headspace (30).

18 Claims, 11 Drawing Sheets

(51) Int. Cl.
*B65D 45/06* (2006.01)
*B65D 45/24* (2006.01)
*B65D 51/24* (2006.01)

(52) U.S. Cl.
CPC ..... *B65D 51/24* (2013.01); *B65D 81/2053* (2013.01); *B65D 81/2076* (2013.01)

(58) Field of Classification Search
USPC ..... 215/231
See application file for complete search history.

(56) References Cited

U.S. PATENT DOCUMENTS 2,314,167 A * 3/1943 Shaw ..... A61J 1/18 604/403
3,205,923 A * 9/1965 Wilson ..... F16K 24/04 141/291
4,059,113 A * 11/1977 Beinsen ..... A61J 1/00 53/428
4,392,578 A * 7/1983 Fipp ..... B65D 81/2076 215/231
4,475,576 A * 10/1984 Simon ..... C12H 1/16 141/302
4,640,426 A * 2/1987 Wasley ..... B65B 31/047 215/228
4,746,027 A * 5/1988 Coker ..... B65D 45/22 215/293
4,809,884 A * 3/1989 Stackhouse ..... B67D 1/045 222/153.04
4,842,151 A * 6/1989 Scott ..... B65D 51/165 215/228
5,322,094 A * 6/1994 Janesko ..... B65B 31/047 137/845
5,329,975 A * 7/1994 Heitel ..... B65D 83/42 141/19
5,406,992 A * 4/1995 Miramon ..... A47G 19/2272 141/64
6,409,033 B1 * 6/2002 Wilhite ..... B65D 51/24 215/228
6,832,634 B1 * 12/2004 Chantalat ..... B01F 3/04794 141/64
7,896,203 B2 * 3/2011 Myron ..... B67D 1/0425 222/209
2003/0029504 A1 * 2/2003 Neugebauer ..... F16K 17/0426 137/538
2004/0069784 A1 * 4/2004 Reutter ..... B65D 51/16 220/304
2006/0237067 A1 * 10/2006 Lee ..... F17C 13/04 137/588
2009/0008356 A1 * 1/2009 Gadzic ..... B65D 51/26 215/310
2010/0327010 A1 * 12/2010 Manera ..... B65D 47/2031 141/357
2010/0330603 A1 * 12/2010 Zhu ..... G01N 1/2205 435/29
2012/0152571 A1 * 6/2012 Andreas ..... A62C 35/68 169/20
2012/0181287 A1 * 7/2012 Holbeche ..... F16K 17/16 220/582
2012/0312770 A1 * 12/2012 Agarkov ..... B65D 39/12 215/253
2014/0262899 A1 * 9/2014 Mociak ..... B65D 51/1683 206/459.1
2014/0263453 A1 * 9/2014 Haley ..... B65D 79/005 222/152
2015/0247605 A1 * 9/2015 Despres ..... F17C 13/04 222/1
2018/0257841 A1 * 9/2018 Juni ..... B65B 31/047

FOREIGN PATENT DOCUMENTS

ES 2 242 493 11/2005
FR 2 903 671 1/2008
GB 2 199 815 7/1988
GB 2 326 635 12/1998
GB 2 425 769 11/2006

OTHER PUBLICATIONS

Written Opinion in PCT/GB2017/050205 dated Aug. 3, 2017.
Search report in GB1601474.8 dated May 5, 2016.

* cited by examiner

VESSEL CAP

This invention relates to a cap for sealing a vessel. It is particularly suitable for, but by no means limited to, use on a neck of a bottle containing carbonated liquid.

BACKGROUND

It is well known that once a vessel of sparkling liquid is opened, for example a bottle of champagne or other sparkling wine, the 'sparkle' beings to leave the wine. There are many re-sealable bottle tops that seek to replace the cork of the bottle and prevent further gas from escaping the bottle. However, these solutions do not address either:

a) the further escape of gas from the liquid into the headspace that results in the wine going 'flat', or
b) the degradation that occurs from oxidation of the wine with the air contained within the headspace of the bottle once opened.

Accordingly, a different approach is desirable to mitigate the above two effects.

SUMMARY

According to a first aspect there is provided a vessel cap as defined in claim 1 of the appended claims. Thus there is provided a vessel cap for exchanging gas in and pressuring a vessel headspace, the cap comprising a cap inlet, a seal arranged to form a gas-tight seal on a vessel opening, a pressure reducing valve, a gas inlet port arranged to allow incoming gas into the vessel headspace, a gas outlet port arranged to allow outgoing gas to escape from the vessel headspace.

Optionally, the pressure reducing valve is arranged to allow gas at a first pressure at the cap inlet to exit the gas inlet into the vessel headspace at a second pressure reduced from the first pressure.

Optionally, the cap further comprises an opening member positioned proximate the vessel cap inlet and arranged to initiate a gas supply.

Optionally, the pressure reducing valve comprises a movable member, the movable member having a first surface in fluid communication with the cap inlet.

Optionally, the movable member is arranged such that gas from a supply at a first pressure acts on the first surface to cause the movable member to move to an open position.

Optionally, wherein when in the open position, the cap inlet is in fluid communication with the gas inlet port.

Optionally, wherein the gas outlet port further comprises apparatus to seal the outlet port when pressure in the vessel headspace reaches a third pressure.

Optionally, wherein the apparatus to seal the outlet port comprises a ball.

Optionally, wherein the movable member further comprises a second surface, wherein gas within the headspace of the vessel acts on the second surface to cause the movable member to move to a closed position after the pressure in the headspace rises following sealing of the outlet port.

Optionally, the movable member is caused to close when the pressure in the vessel headspace reaches the second pressure.

Optionally, wherein the gas inlet port comprises a non-return valve.

Optionally, the gas outlet allows outgoing gas to escape to atmosphere.

Optionally, the cap further comprises a two-stage seal and unseal arrangement.

Optionally, the cap further comprises a lever comprising a lip arranged to engage with the neck of the vessel to provide the gas-tight seal.

Optionally, the lever comprises a lip angled to allow gas release from the vessel prior to removing the cap from the vessel.

Optionally, the cap further comprises a clip portion comprising protrusions for location under a neck bead of the vessel in the first seal stage and further comprising a clamp portion for sealing the seal of the cap against the vessel opening in the second seal stage.

Optionally, the cap wherein the clamp portion is arranged to allow gas release from the vessel while the cap is retained by the protrusions on the vessel in a first unseal stage prior to removing the cap from the vessel in the second unseal stage.

Optionally, the first pressure is approximately 120 psi.

Optionally, the second pressure is approximately 40 psi.

Optionally, the third pressure is in the range of 20 to 30 psi.

Optionally, the incoming gas comprises carbon dioxide.

Optionally, the outgoing gas comprises air.

According to a second aspect there is provided a method as defined in claim 23. Accordingly there is provided a method for exchanging gas in and pressuring a vessel headspace, the method comprising providing a cap inlet, providing a seal arranged to form a gas-tight seal on a vessel opening, providing a pressure reducing valve, providing a gas inlet port arranged to allow incoming gas into the vessel headspace, providing a gas outlet port arranged to allow outgoing gas to escape from the vessel headspace.

Optionally, the method wherein the pressure reducing valve is arranged to allow gas at a first pressure at the cap inlet to exit the gas inlet into the vessel headspace at a second pressure reduced from the first pressure.

Optionally, the method wherein the cap further comprises an opening member positioned proximate the vessel cap inlet and arranged to initiate a gas supply.

Optionally, the method wherein the pressure reducing valve comprises a movable member, the movable member having a first surface in fluid communication with the cap inlet.

Optionally, the method wherein the movable member is arranged such that gas from a supply at a first pressure acts on the first surface to cause the movable member to move to an open position.

Optionally, the method wherein when in the open position, the cap inlet is in fluid communication with the gas inlet port.

Optionally, the method wherein the gas outlet port further comprises apparatus to seal the outlet port when pressure in the vessel headspace reaches a third pressure.

Optionally, the method wherein the apparatus to seal the outlet port comprises a ball.

Optionally, the method wherein the movable member further comprises a second surface, wherein gas within the headspace of the vessel acts on the second surface to cause the movable member to move to a closed position after the pressure in the headspace rises following sealing of the outlet port.

Optionally, the method wherein the movable member is caused to close when the pressure in the vessel headspace reaches the second pressure.

Optionally, the method wherein the gas inlet port comprises a non-return valve.

Optionally, the method wherein the gas outlet allows outgoing gas to escape to atmosphere.

Optionally, the method further comprising a two-stage seal and unseal arrangement.

Optionally, the method wherein the cap further comprises a lever comprising a lip arranged to engage with the neck of the vessel to provide the gas-tight seal.

Optionally, the method wherein the lever comprises a lip angled to allow gas release from the vessel prior to removing the cap from the vessel.

Optionally, the method where in the cap further comprising a clip portion comprising protrusions for location under a neck bead of the vessel in the first seal stage and further comprising a clamp portion for sealing the seal of the cap against the vessel opening in the second seal stage.

Optionally, the method wherein the clamp portion is arranged to allow gas release from the vessel while the cap is retained by the protrusions on the vessel in a first unseal stage prior to removing the cap from the vessel in the second unseal stage.

Optionally, the method wherein the first pressure is approximately 120 psi.

Optionally, the method wherein the second pressure is approximately 40 psi.

Optionally, the method wherein the third pressure is in the range of 20 to 30 psi.

Optionally, the method wherein the incoming gas comprises carbon dioxide.

Optionally, the method wherein the outgoing gas comprises air.

With all the aspects, preferable and optional features are defined in the dependent claims.

BRIEF DESCRIPTION OF THE DRAWINGS

Embodiments will now be described, by way of example only, and with reference to the drawings in which.

In the figures, like elements are indicated by like reference numerals throughout.

Overview Disclosed herein is a cap for a vessel such as a bottle containing a sparkling beverage, for example wine. The cap provides a gas-tight seal to control the headspace of the bottle. Gas (preferably carbon dioxide) can be provided into the headspace both to re-pressurise the headspace to prevent further gas evolving from the liquid into the headspace, and to displace the air (oxygen) in the headspace such that oxidation of the wine is greatly reduced.

Once re-pressurised, the cap remains in place until it is safely removed in order to serve some of the wine. The process may then be repeated in order to keep the wine sparkling and fresh regardless of how much wine is left within the bottle.

This allows a good quality delivery of sparkling wine whether the bottle is either brand new, or even if it has been open for a several weeks or more.

DETAILED DESCRIPTION

Figure 1:
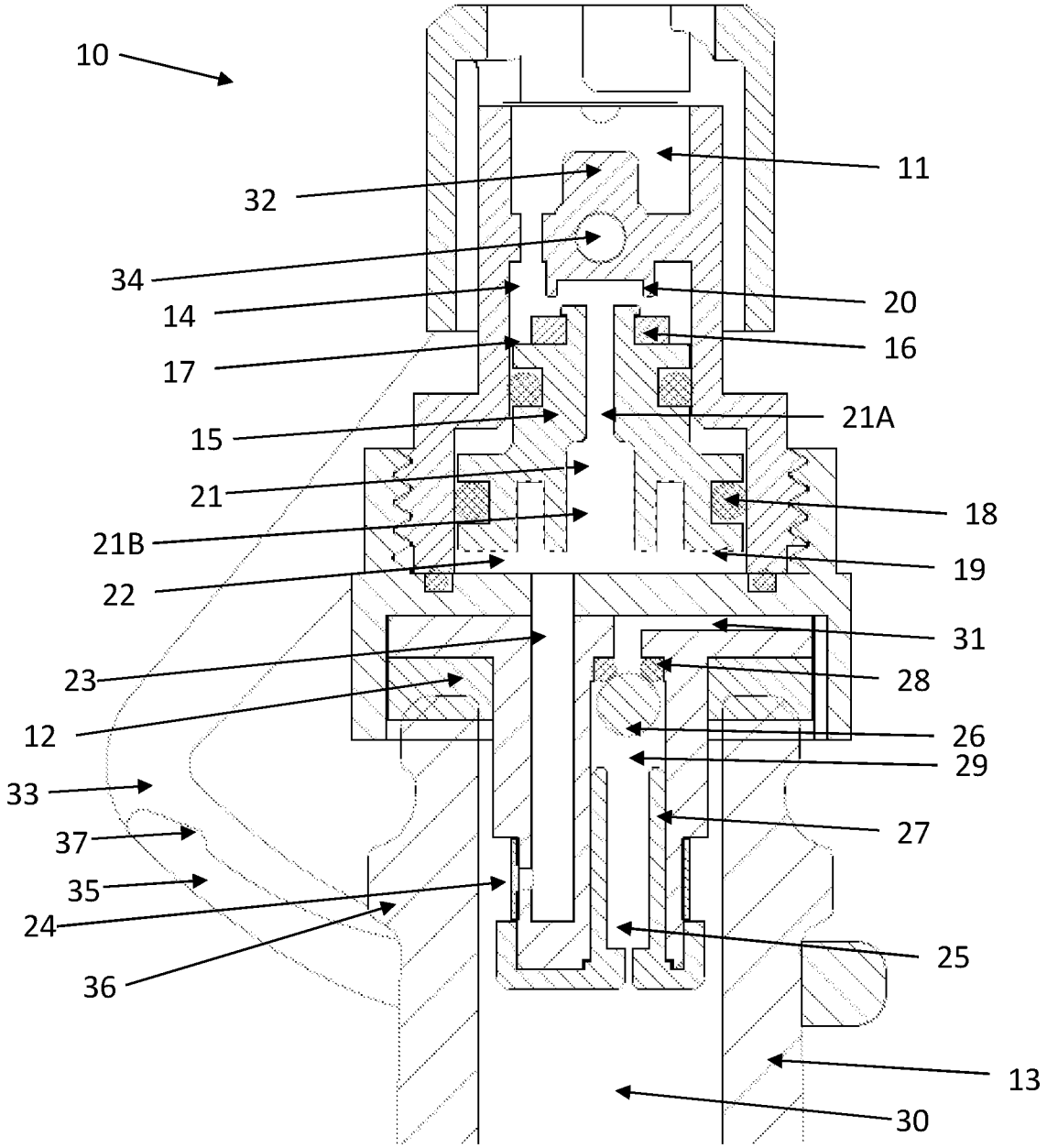
FIG. 1 illustrates a valve cap according to an embodiment.

FIG. 1 shows a cap 10 according to an embodiment. The cap comprises a cap inlet 11 through which incoming pressurised gas enters the cap assembly. A seal, such as but not limited to a flat-seal 12 forms a gas-tight seal with the vessel opening, for example a bottle neck 13. Cap inlet 11 is in fluid communication with a chamber 14.

Pressurised gas may flow into inlet 11 and then chamber 14. Cap 10 further comprises a pressure reducing valve comprising a movable member 15, for example a piston. Movable member comprises a first seal 16 proximate a first surface 17 and a second seal 18 proximate a second surface 19, the second surface being denoted by dashed lines in FIG. 1 for clarity. First and second seals may each comprise an annular sealing ring or a washer.

Figure 2:
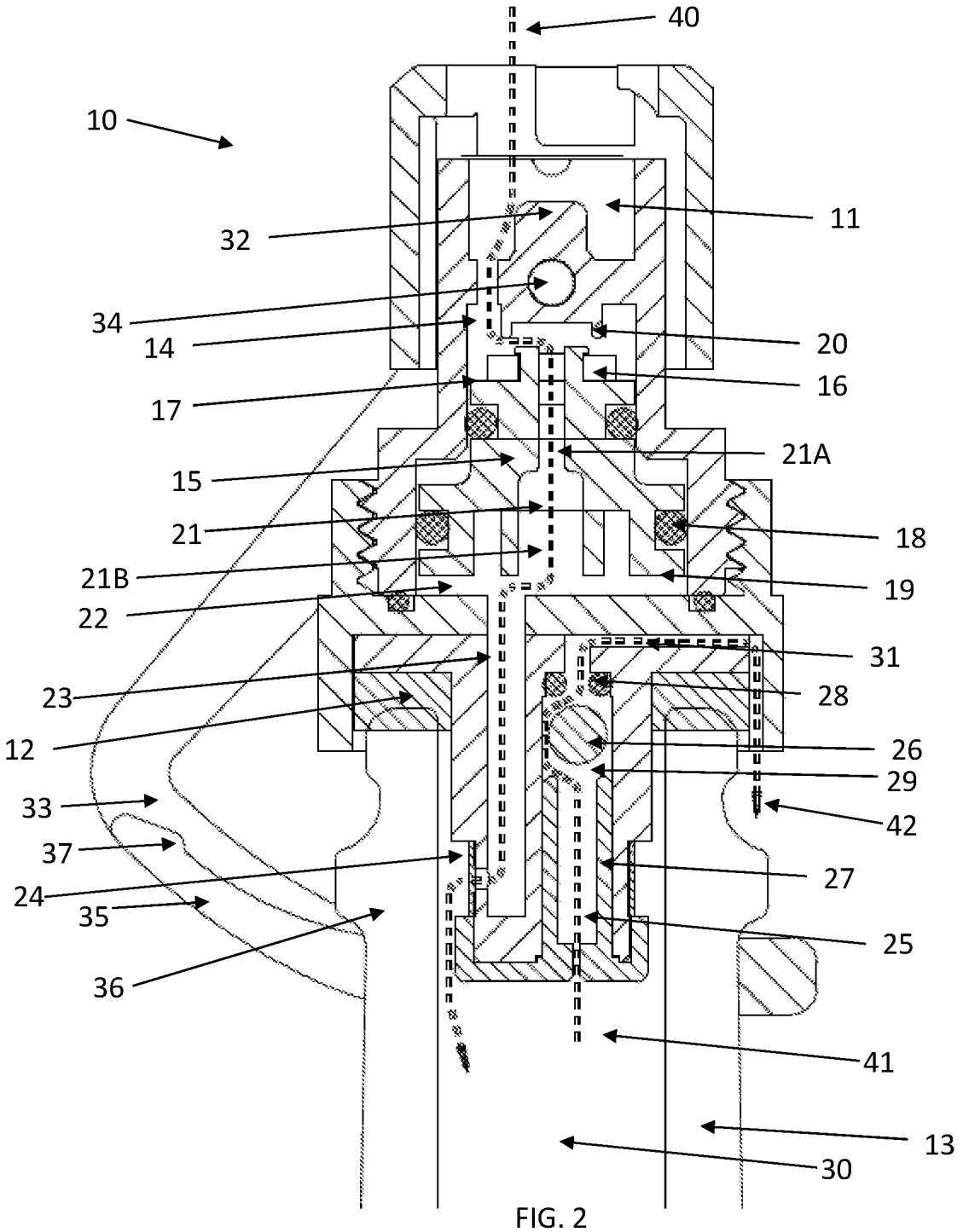
FIG. 2 illustrates a valve cap according to an embodiment where the valve is open and gas can escape to atmosphere.
Figure 3:
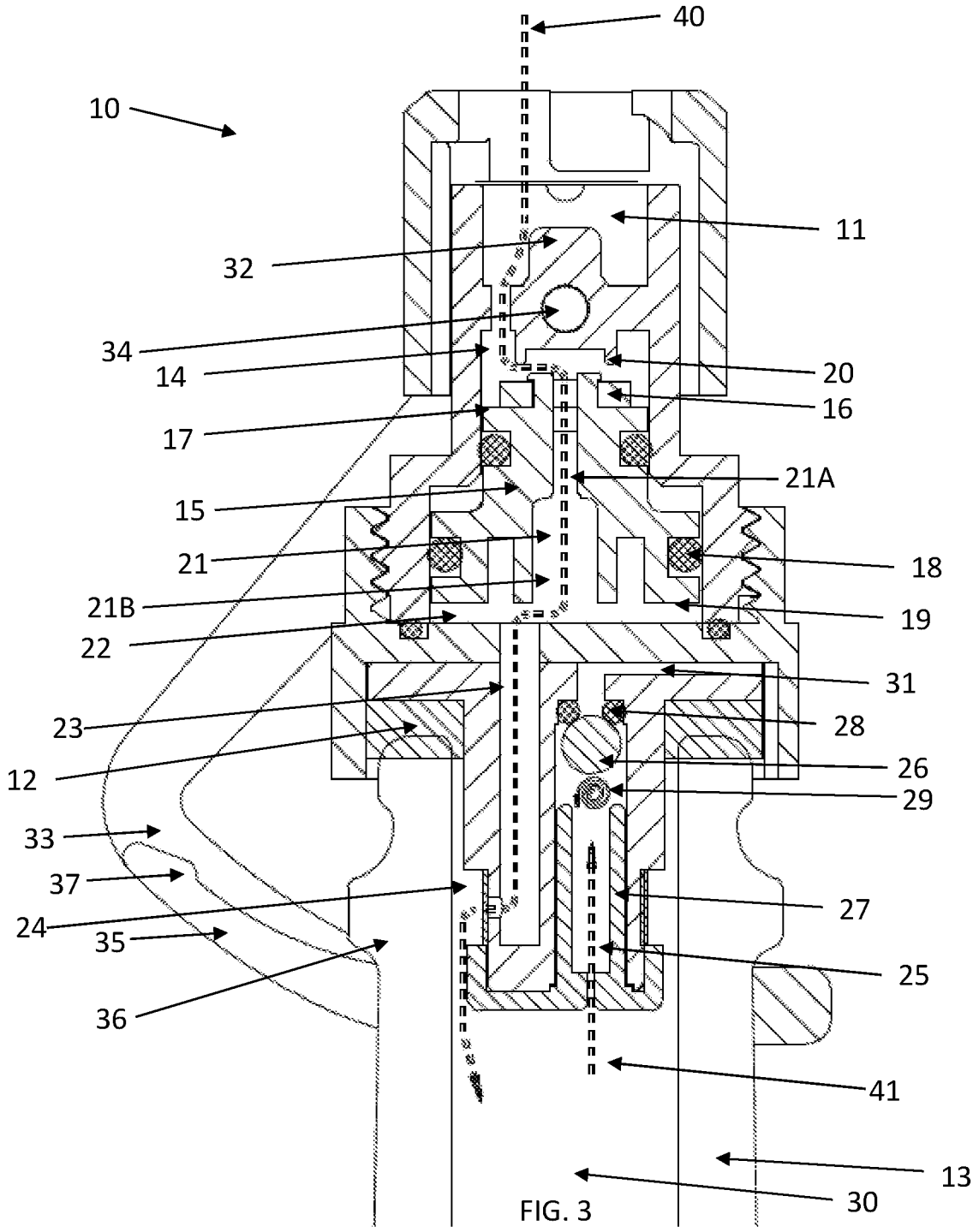
FIG. 3 illustrates a valve cap according to an embodiment where the valve is open and gas cannot escape to atmosphere.
Figure 4:
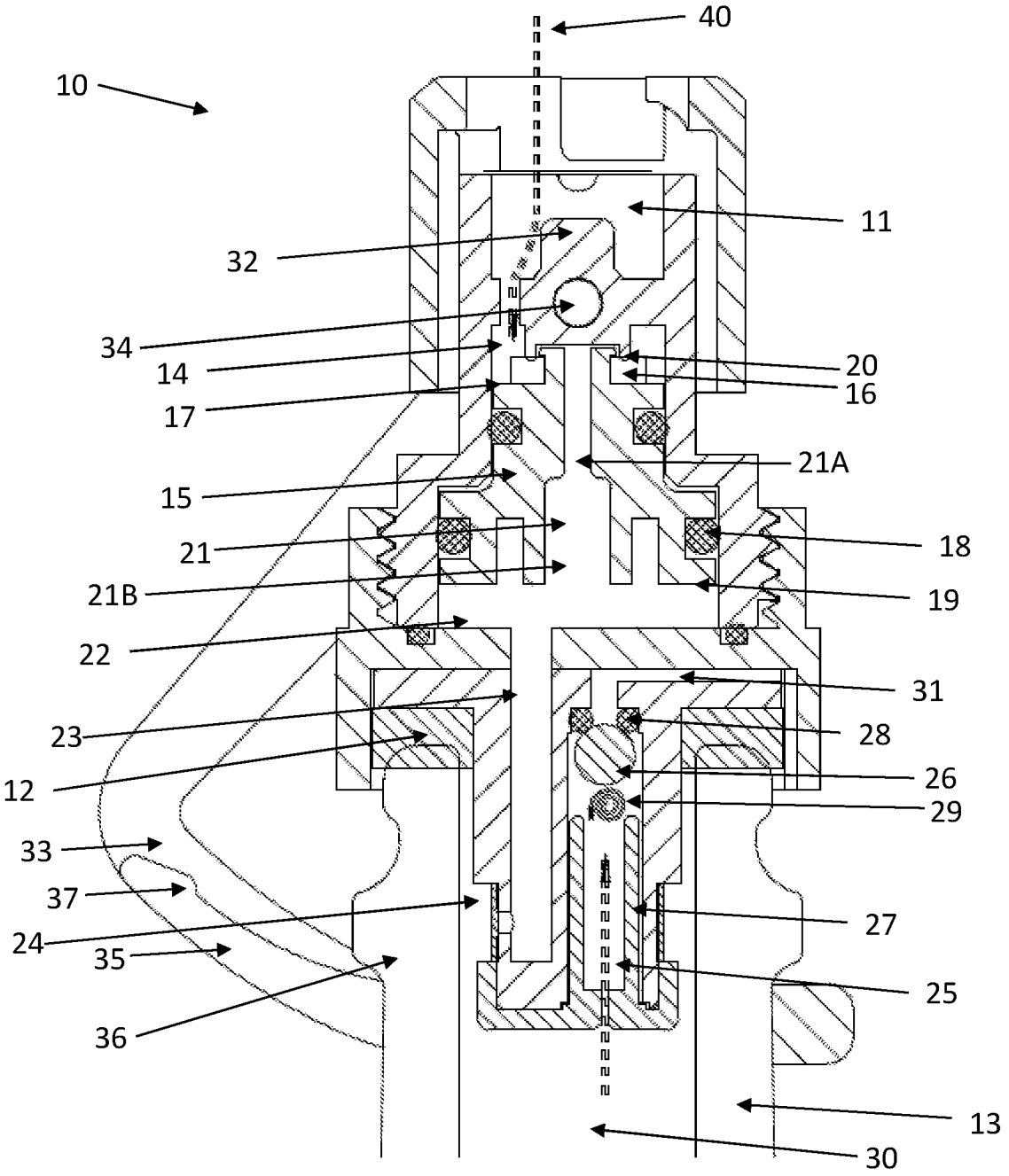
FIG. 4 illustrates a valve cap according to an embodiment where the valve is closed and gas cannot escape to atmosphere.

The movable member may move between an open position as illustrated in FIGS. 1, 2 and 3, and a closed position as illustrated in FIG. 4. In the closed position, seal 16 forms a gas-tight seal with flange 20. In the open position, seal 16 does not form a gas-tight seal with flange 20 as the movable member is displaced away from flange 20 such that a first chamber 14 is in fluid communication with port 21 and a second chamber 22 within movable member 15. Port 21 comprises a first portion 21A having a smaller volume than a second portion 21B. As can be seen, second chamber 22 in conjunction with port 21 is of a larger volume than first chamber 14. In both the closed and open positions of movable member 15, chamber 14 is in fluid communication with first surface 17.

An outlet port 23 which is in fluid communication with second chamber 22 provides a path from cap inlet 11 to the vessel headspace 30 via non-return valve 24 to ensure no reverse liquid ingress from the vessel.

Non-return valve 24 may comprise a band or needle valve for example.

Gas outlet port 25 is in fluid communication with the vessel headspace as can be seen in FIG. 1. A sealing apparatus 26 of the gas outlet port 25, for example a ball, or any other form of non-return valve is held movably captive within a chamber 29 by flange 27 and seal 28. The sealing apparatus may move between a closed position wherein the sealing apparatus forms a seal with seal 28 thus isolating chamber 29 from port 31, and an open position wherein the sealing apparatus does not form a seal with seal 28 and hence chamber 29 is in fluid communication with port 31. Alternatively, sealing apparatus 26 of gas outlet port 25 may comprise a needle in a bore operated manually by a user, whereby chamber 29 is brought into fluid communication with port 31 manually.

Port 31 is open to atmosphere and is preferably radial with respect to the vessel opening. The position of the port opening to atmosphere may be altered from that shown in the figures as long as a vent to atmosphere is achieved.

As can be seen from the figures, the cap is of a generally axial design about the axis of the vessel to be sealed. Any of the seals described is herein may comprise an annular sealing ring, a washer an o-ring or a flat seal.

Vessel cap 10 may comprise a bayonet or a screw-fit (not shown), or another secure attachment means for safely mating with an apparatus comprising a pressurised gas supply. In order to initiate an incoming pressurised gas supply, vessel cap 10 may comprise initiating member 32 for opening a valve or other safety mechanism of a gas supply. Such a suitable gas supply apparatus is described in co-pending UK patent application 1513361.4 "Valve".

Vessel cap also comprises a lever 33, preferably sprung, and pivoting at fulcrum 34. Lever 33 comprises two halves (one each side of the vessel in question), only one half is shown in the figures for clarity. The arrangement of the lever and pivot provides a two stage seal and unseal movement to allow safe removal of the cap from a pressurised headspace. Feature 35 of lever 33 provides a lip or other suitable contour to movably engage with the underside of vessel neck lip 36, or another suitable feature of the vessel in question. As the lever is moved anti-clockwise from the point of view of the figures, feature 35 and neck lip 36 act as a cam-follower arrangement such that after moving past the position of lip 37 which forces the cap down onto the bottle neck 13 with more force, a gas tight seal is formed between seal 12 and the vessel opening (the first stage of movement). When removing the cap, the lever is moved clockwise to the position as shown in the figures, the second stage of movement (the lever shown in this position for clarity, not a pressurising operational position) whereby seal 12 is partially released from the vessel neck such that pressure in the headspace can be released while the cap remains captive on the vessel neck to avoid a dangerous discharge scenario whereby the cap is propelled from the neck due to the increased pressure in the headspace. In the second stage of movement, a further lip following the contour of feature 35 (hidden behind the vessel neck in the figures as would be understood) retains the lever in the second stage of movement without additional force being applied by a user. With this arrangement, once the pressure is released, additional force can be applied to fully release the lever by moving fully clockwise according to the figures such that the cap may be taken from the vessel neck. As would be understood, vessel neck lip 36 may also be known as the vessel neck bead.

Operation of vessel cap 10 will now be described as shown in FIGS. 2 to 4.

Subsequent to mating with a pressurised gas supply, for example by way of initiating member 32, incoming pressurised gas 40 flows through cap inlet 11 and into chamber 14. The incoming flow of gas is shown by dashed line 40 in FIGS. 2 and 3.

The incoming gas may be pressurised to a first pressure of approximately 110-130 psi, preferably 120 psi depending on the ambient temperature as would be understood. This is to optimise valve closure and fill-time as will be described herein, and is achieved from an initial pressure of approximately 800 psi (carbon dioxide vapour pressure at 20° C.).

The pressurised gas 40 acts upon first surface 17 to push the movable member 15 from the closed position to the open position. In turn, this brings chamber 14 into fluid communication with port 21. The second portion 21B of chamber 21 that comprises the larger volume than the first portion 21A of chamber 21 allows movable member 15 to freely move from the closed position to the open position as the pressure is reduced in port 21 and chamber 22 compared to chamber 14 as would be understood.

Once the incoming gas has entered chamber 22, it may pass through outlet port 23 and into headspace 30 via non-return valve 24. The gas flow path is shown in both FIGS. 2 and 3 by way of dashed line 40. Gas in chamber 22 is at a second pressure reduced from the first pressure after flowing through port 21 which with movable member 15 act as a pressure reducing valve. The second pressure may be 30-100 psi, and preferably 35-45 psi, and still further preferably 40 psi for optimum gas usage and to hold carbonisation of the liquid in the vessel in equilibrium.

The gas flowing into the headspace is preferably carbon dioxide as is typically used with consumable food. When using carbon dioxide, as the gas flows into the headspace, the air that is present in the headspace is displaced towards the vessel exit by way of carbon dioxide being heavier than air. At the same time, the pressure in the headspace begins to rise as the amount of incoming gas increases in the headspace.

As would be understood, as the pressure in the headspace 30 rises, the lighter air which has risen in the headspace is pushed into gas outlet port 25 as shown by dashed arrow 41. The gas may flow around ball 26 and into port 31 which leads to atmosphere. Hence, the air that is displaced by the pressure rise in the headspace is vented to atmosphere as shown by dashed path 42.

As the pressure in the headspace continues to rise, ball 26 is pushed away from flange 27 towards seal 28. When the pressure in the vessel headspace and hence outlet 25 reaches a third pressure, the ball is displaced enough to form a seal against seal 28. Path 42 previously taken by escaping air from the headspace is no longer open as shown in FIG. 3. The third pressure may be in the range of 10-60 psi, and preferably 20-30 psi for optimum vent time for air exchange versus pressurised gas wastage.

When outlet port 25 becomes closed, pressurised gas at the first pressure continues to enter the headspace following path 40 as previously described. Owing to outlet 25 being closed, the pressure in the headspace rises further. Pressure therefore rises on the second surface 19 of movable member 15. When the pressure within the headspace and hence outlet port 23 reaches the second pressure, the force on the second surface is greater than the opposite force on the first surface pressure from the incoming gas such that the movable member moves to the closed position where seal 16 forms a gas-tight seal with flange 20 as shown in FIG. 4. At this moment, the pressurised headspace of the vessel is sealed off from atmosphere by both ball 26 against seal 28, and seal 16 against flange 20. The gas composition of the headspace is therefore carbon dioxide at the second pressure (preferably approximately 40 psi) or another gas as provided from a gas source.

Figure 5:
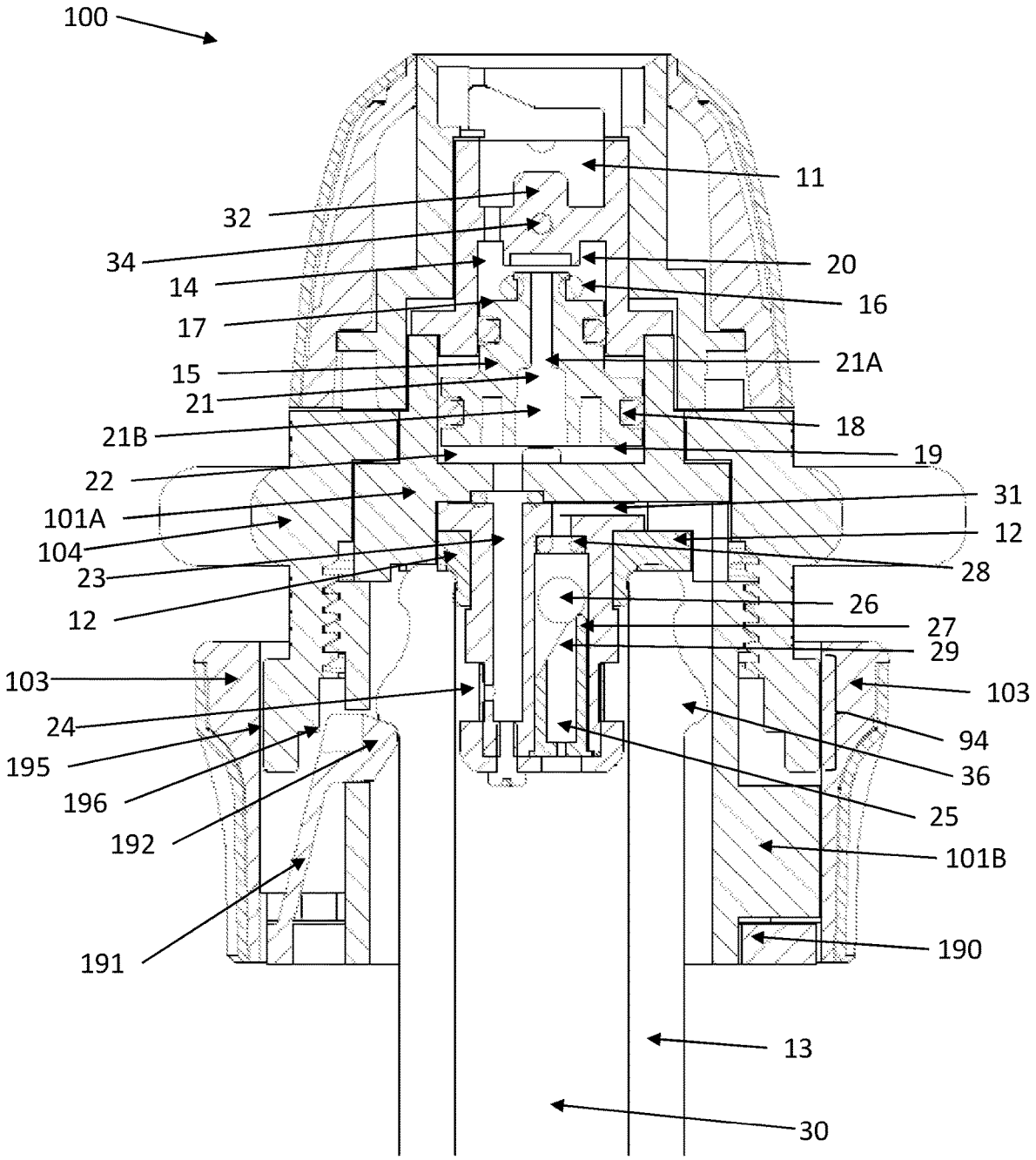
FIG. 5 illustrates a valve cap according to an embodiment.

In another embodiment the vessel cap 100 may comprise a two stage seal and unseal movement different to the lever arrangement of cap 10. As can be seen from the figures, the cap 100, in the same manner as cap 10 is of a generally axial design about the axis of the vessel to be sealed. Turning to FIG. 5, operation of the vessel cap 100 is identical to that of cap 10 as previously described in relation to FIGS. 2 to 4 once seal 12 has formed a gas-tight seal with the vessel opening. Like reference numerals are used in FIGS. 1 to 8 as appropriate.

The two-stage seal and unseal arrangement of cap 100 will now be described. Vessel cap 100 comprises a screw arrangement comprising an inner portion 101, a clip portion 102, a sleeve portion 103 and a clamp portion 104.

Figure 8:
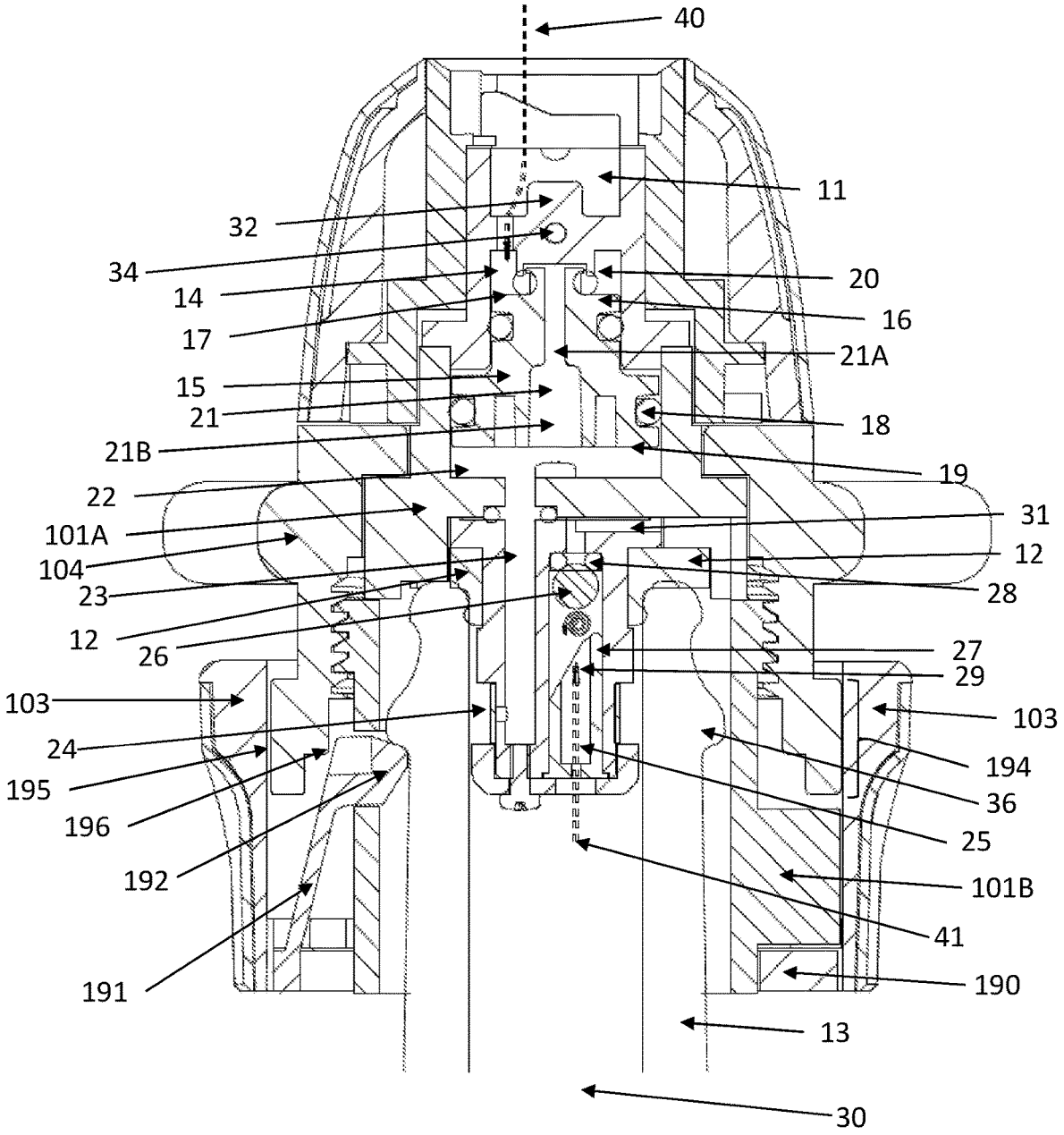
FIG. 8 illustrates a valve cap according to an embodiment where the valve is closed and gas cannot escape to atmosphere.
Figure 9:
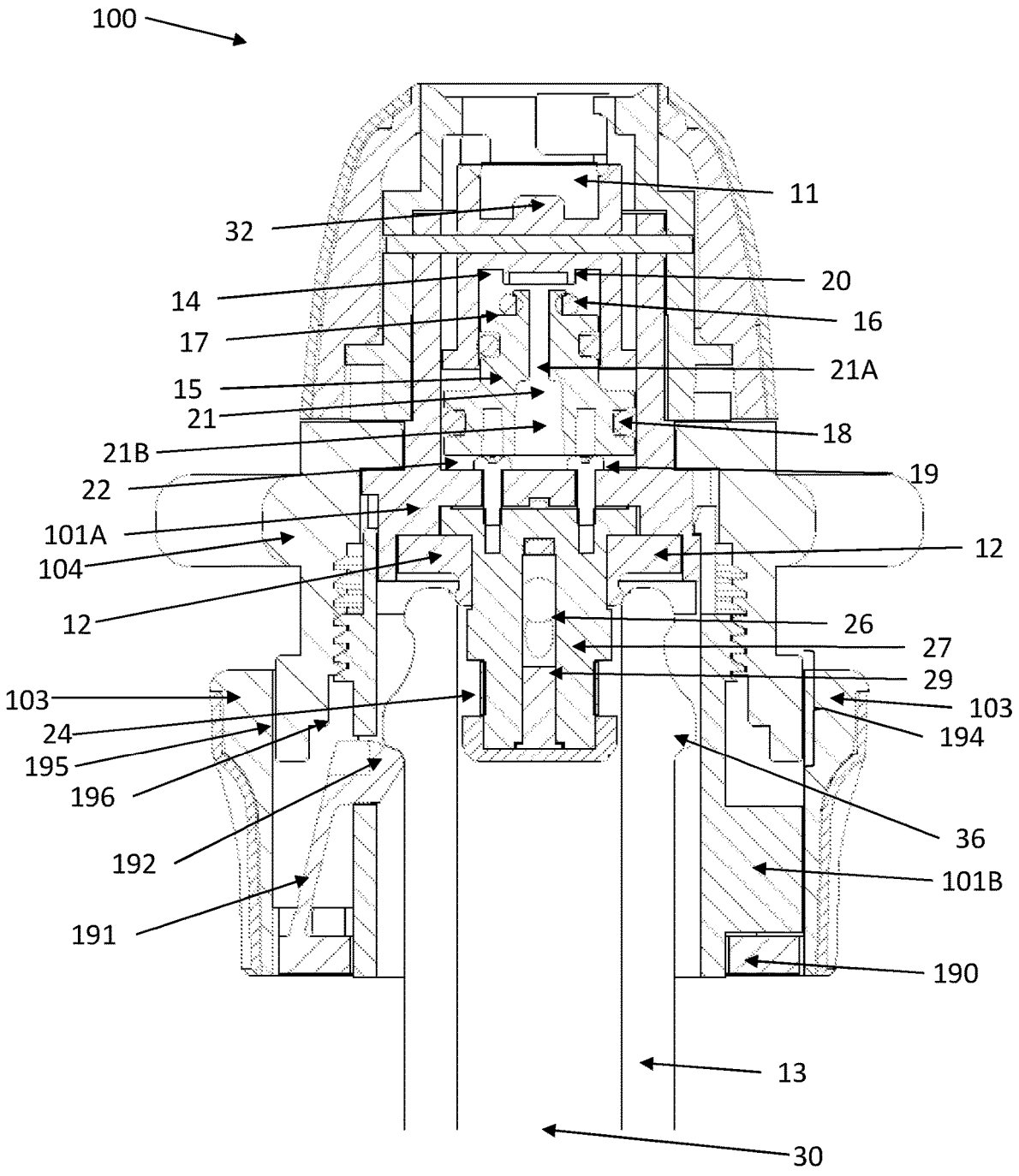
FIG. 9 illustrates a valve cap according to an embodiment in a pressure release position.
Figure 10A:
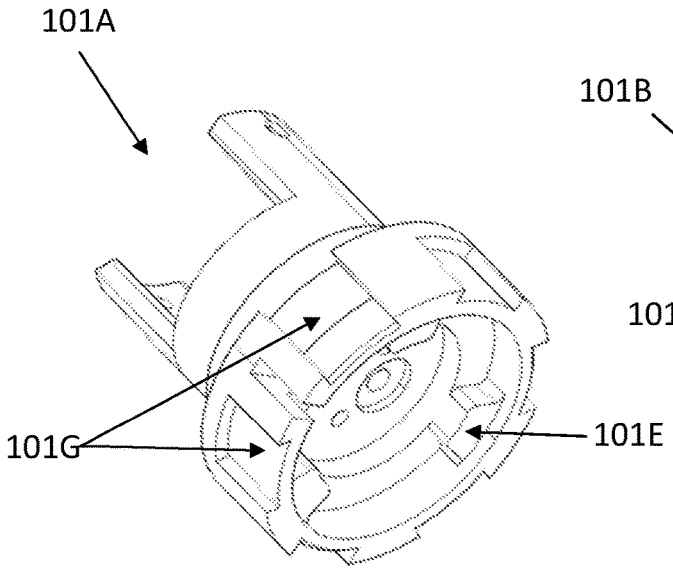
FIG. 10A illustrates an inner portion (upper part) according to an embodiment.
Figure 10B:
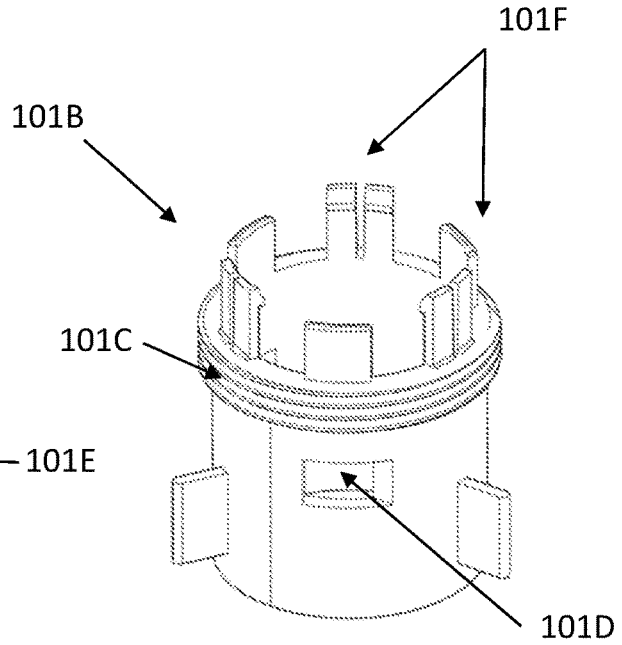
FIG. 10B illustrates an inner portion (lower part) according to an embodiment.

FIGS. 10A and 10B illustrates the inner portion 101 which comprises two separate parts (upper part 101A and lower 101B) for manufacturing purposes. When installed on a vessel, lower part 101B is positioned further down the vessel (bottle) neck than upper part 101A as shown in FIGS. 5 to 9. Parts 101A and 101B mate by way of clips and tabs 101F and corresponding locaters 101G such that the two parts are retained together, but are able to separate with a limited movement when the cap 100 is fully assembled. An outer screw thread 101C is present on lower part 101B. Lower part 101B also comprises a plurality of cutouts 101D around its periphery.

Figure 11:
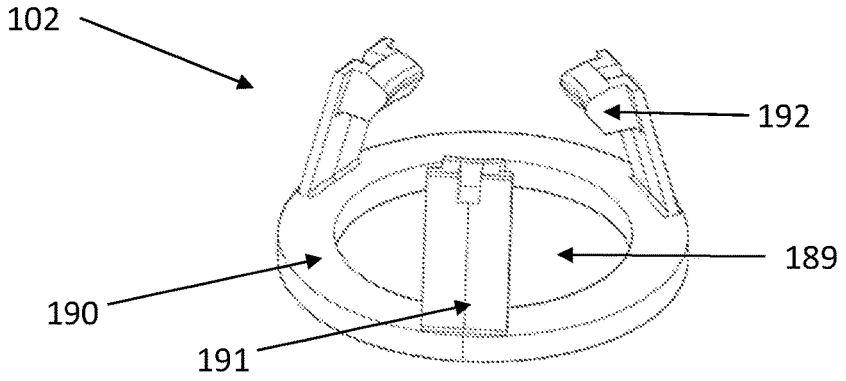
FIG. 11 illustrates a clip portion according to an embodiment.

FIG. 11 illustrates clip portion 102. A base section 190 forms a central aperture 189 and a base for a plurality of arms 191. Each arm is formed with an inward bias and comprises an inner facing protrusion 192 for location under a lip of a vessel opening, for example the neck bead of a bottle. Preferably clip portion 102 comprises three arms. Base section 190 is illustrated as a ring shape, but may comprise any shape is suitable for supporting arms 191.

Figure 12:
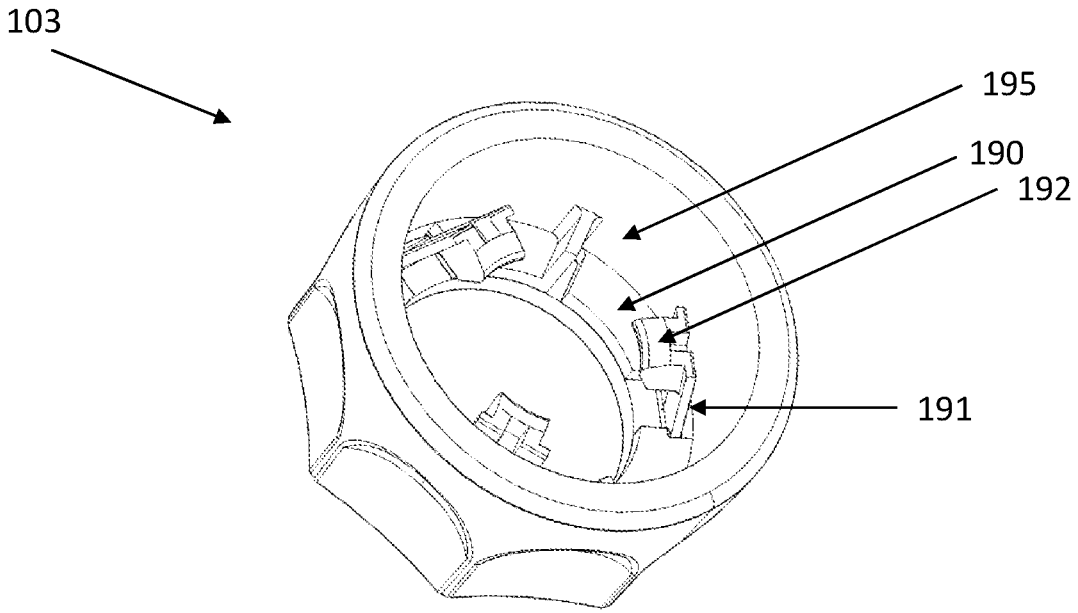
FIG. 12 illustrates a sleeve portion assembled on the clip portion according to an embodiment.

FIG. 12 illustrates sleeve portion 103. Sleeve portion 103 is sized so as to fit over clip portion 102 as shown.

Figure 13:
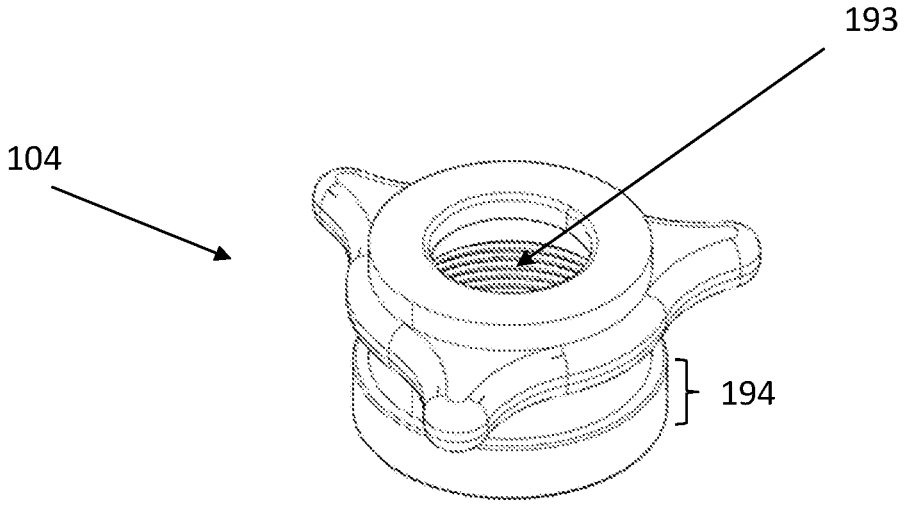
FIG. 13 illustrates a clamp portion according to an embodiment.

FIG. 13 illustrates clamp portion 104. Clamp portion 104 comprises a generally cylindrical shape with an inner thread 193 for mating with thread 101C of the lower part 101B. A cylindrical lower portion 194 of clamp portion 104 is dimensioned so as to engage in a sliding manner with an inner surface 195 of sleeve portion 103 as shown in FIGS. 5 to 8.

When locating vessel cap 100 on a vessel, for example a bottle neck, in a first seal stage, inner portion 101, clip portion 102 and sleeve portion 103 are placed over the neck 13 as shown in FIGS. 5 to 9. Protrusions 192 of clip portion 102 are located in corresponding cutouts 101D around the periphery of lower portion 101B. Arms 191 are able to deform outwards in a spring-like manner to allow bottle neck 13 comprising neck bead 36 to pass through the central aperture 189.

Sleeve portion 103 is positioned so as to rest on the base 190 of clip portion 102. Clip portion 102 is positioned such that the protrusions 192 are captive under the neck bead 36 of bottle 13 as shown in FIGS. 5 to 9.

In a second seal stage, the rest of cap 100 is now positioned by way of the clamp portion 104. As clamp portion 104 is screwed onto thread 101C of lower portion 101B, seal 12 is lowered onto vessel (bottle neck 13). As can be seen from FIGS. 5 to 9, cap 100 is in alignment with the axis of the vessel to be sealed. The compression motion of clamp portion 104 on seal 12 is limited by one or more 'stop' flanges 101E positioned on an inner periphery of upper part 101A of inner portion 101. The stop detail is arranged so that should the internal pressure in the vessel exceed 100 psi, the seal is able to fail to release excess pressure to atmosphere to avoid a catastrophic failure of the vessel due to over-pressurisation. Cylindrical lower portion 194 of clamp portion 104 comprises an inner lip 196 (forming a smaller diameter than the rest of portion 194) arranged to ensure arms 191 and hence protrusions 192 remain under neck bead 36 and therefore the entire cap 100 remains captive on the vessel neck/opening as shown in FIGS. 5 to 8.

As shown throughout FIGS. 5 to 8, seal 12 may comprise a substantially flat section 12A for sealing against a vessel top and a lip section 12B for sealing inside a vessel neck, for example a bottle neck.

Figure 6:
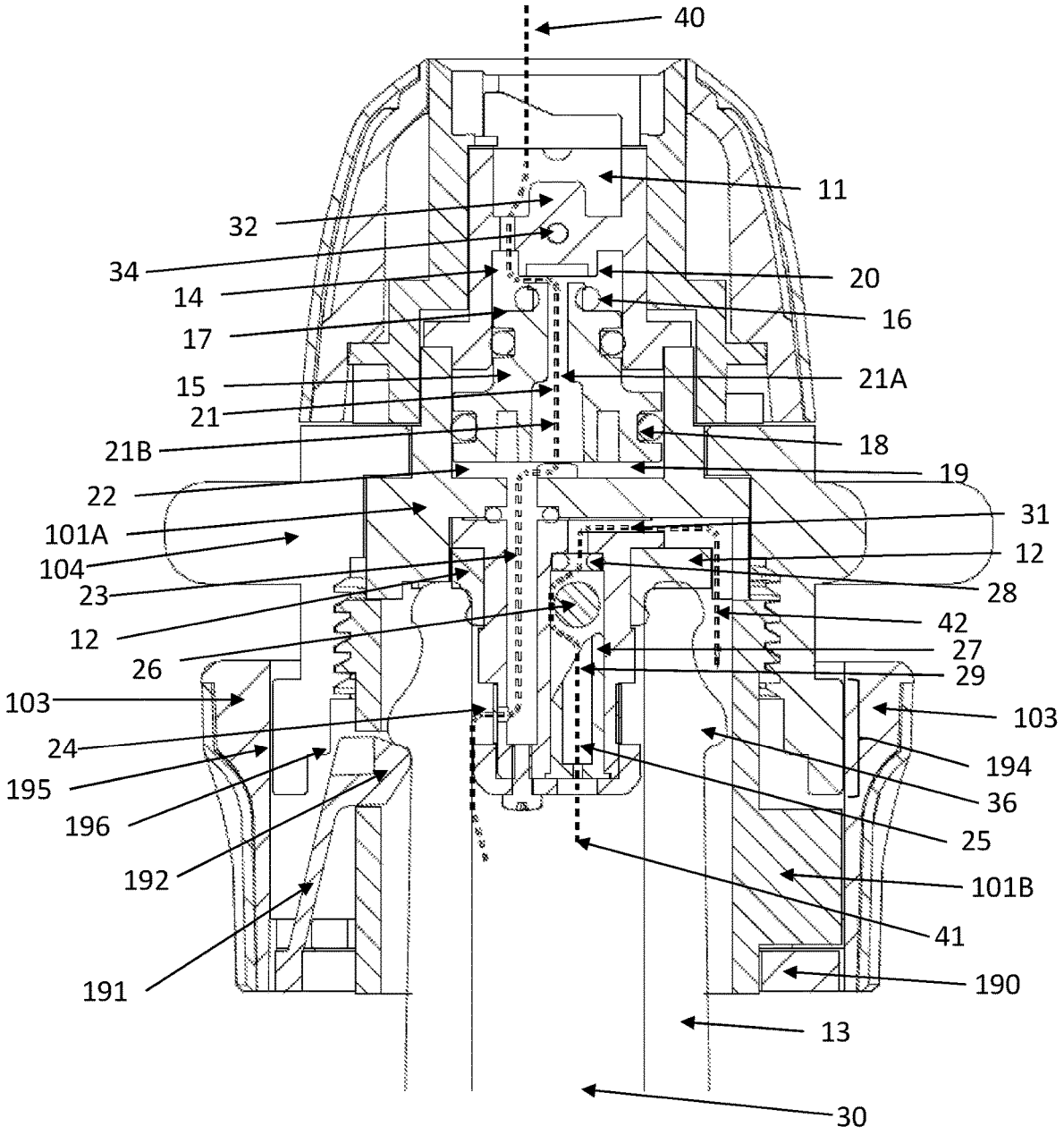
FIG. 6 illustrates a valve cap according to an embodiment where the valve is open and gas can escape to atmosphere.
Figure 7:
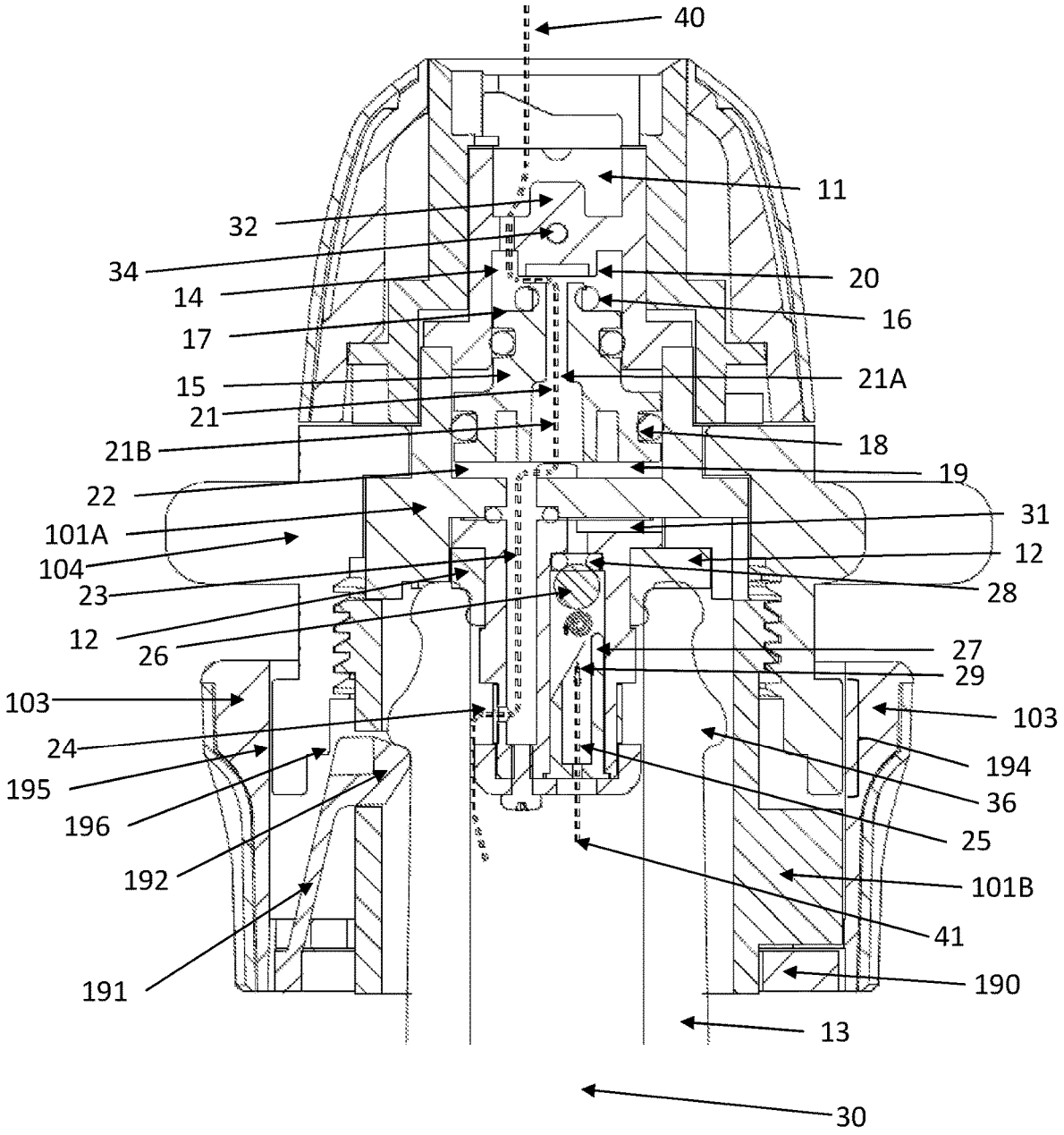
FIG. 7 illustrates a valve cap according to an embodiment where the valve is open and gas cannot escape to atmosphere.

With the clamp portion 104 screwed down as far as is allowed, operation of the cap 100 as per cap 10 previously described in relation to FIGS. 2 to 4 (pressurisation and air exchange) can take place. FIGS. 6 to 8 show gas flow of cap 100 and are analogous to FIGS. 2 to 4.

When it is desired to release cap 100 from a vessel, a two-stage process is employed in the same manner as the lever arrangement of cap 10. In a first unseal stage, clamp portion 104 is unscrewed and moves upwards as illustrated in FIG. 9 to a pressure release position. As clamp portion 104 moves upwards, inner lip 196 moves away from arms 191 but not enough to allow arms 191 to entirely disengage from cutouts 101D. At the same time, seal 12 is released from captivity and the internal pressure of the pressurised contents of the vessel cause the seal to break from the bottle neck 13. Parts 101A and 101B may also separate in a limited manner by virtue of features 101F and 101G as previously described. Excess pressure in the vessel is therefore vented to atmosphere before cap 100 can be fully disengaged from the vessel to avoid a dangerous release of cap 100.

Once the initial pressure has been vented to atmosphere, and cap 100 is in a position as per FIG. 9, in a second unseal stage, sleeve 103 may be moved towards the top of the vessel such that arms 191 may fully disengage from cutouts 101D. At this point, the entirety of cap 100 can be removed from the vessel neck allowing the contents of the vessel to be dispensed as desired. Clamp portion 104 does not need to be fully unscrewed from thread 101C thus allowing the various components of cap 100 to remain as one piece for ease of use.

Thus a vessel cap is provided that allows both air to be removed from a vessel headspace as well as a re-pressurisation of the headspace. This results in the advantages of reducing oxidation of the vessel contents by headspace air, as well as maintaining carbonation by way of eliminating gas evolution from the vessel contents.

The invention claimed is:

1. A vessel cap for exchanging gas in and pressuring a vessel headspace, the cap comprising:

a cap inlet;

a seal arranged to form a gas-tight seal on a vessel opening;

a pressure reducing valve;

a gas inlet port arranged to allow incoming gas into the vessel headspace; and a gas outlet port arranged to allow outgoing gas to escape from the vessel headspace, wherein:

the pressure reducing valve is arranged to allow gas at a first pressure at the cap inlet to exit the gas inlet into the vessel headspace at a second pressure reduced from the first pressure, the pressure reducing valve comprises a movable member, the movable member having a first surface in fluid communication with the cap inlet, the gas outlet port further comprises an apparatus to seal the outlet port when pressure in the vessel headspace reaches a third pressure, and the movable member further comprises a second surface, wherein gas within the headspace of the vessel acts on the second surface to cause the movable member to move to a closed position after the pressure in the headspace rises following sealing of the outlet port.

2. The cap of claim 1 wherein the movable member is arranged such that gas from a supply at a first pressure acts on the first surface to cause the movable member to move to an open position.

3. The cap of claim 2 wherein when in the open position, the cap inlet is in fluid communication with the gas inlet port.

4. The cap of claim 1 wherein the apparatus to seal the outlet port comprises a ball.

5. The cap of claim 1 wherein the movable member is caused to close when the pressure in the vessel headspace reaches the second pressure.

6. The cap of claim 1 further comprising a lever comprising a lip arranged to engage with the neck of the vessel to provide the gas-tight seal.

7. The cap of claim 6 wherein the lever comprises a lip angled to allow gas release from the vessel prior to removing the cap from the vessel.

8. The cap of claim 1 further comprising a clip portion comprising protrusions for location under a neck bead of the vessel in a first seal stage and further comprising a clamp portion for sealing the seal of the cap against the vessel opening in a second seal stage.

9. The cap of claim 8 wherein the clamp portion is arranged to allow gas release from the vessel while the cap is retained by the protrusions on the vessel in a first unseal stage prior to removing the cap from the vessel in a second unseal stage.

10. A method for exchanging gas in and pressuring a vessel headspace, the method comprising:

providing a cap inlet;

providing a seal arranged to form a gas-tight seal on a vessel opening;

providing a pressure reducing valve;

providing a gas inlet port arranged to allow incoming gas into the vessel headspace; and providing a gas outlet port arranged to allow outgoing gas to escape from the vessel headspace, wherein:

the pressure reducing valve is arranged to allow gas at a first pressure at the cap inlet to exit the gas inlet into the vessel headspace at a second pressure reduced from the first pressure, the pressure reducing valve comprises a movable member, the movable member having a first surface in fluid communication with the cap inlet, the gas outlet port further comprises an apparatus to seal the outlet port when pressure in the vessel headspace reaches a third pressure, and the movable member further comprises a second surface, wherein gas within the headspace of the vessel acts on the second surface to cause the movable member to move to a closed position after the pressure in the headspace rises following sealing of the outlet port.

11. The method of claim 10 wherein the movable member is arranged such that gas from a supply at a first pressure acts on the first surface to cause the movable member to move to an open position.

12. The method of claim 11 wherein when in the open position, the cap inlet is in fluid communication with the gas inlet port.

13. The method of claim 10 wherein the apparatus to seal the outlet port comprises a ball.

14. The method of claim 10 wherein the movable member is caused to close when the pressure in the vessel headspace reaches the second pressure.

15. The method of claim 10 wherein the cap further comprises a lever comprising a lip arranged to engage with the neck of the vessel to provide the gas-tight seal.

16. The method of claim 15 wherein the lever comprises a lip angled to allow gas release from the vessel prior to removing the cap from the vessel.

17. The method of claim 10 further comprising a clip portion comprising protrusions for location under a neck bead of the vessel in a first seal stage and further comprising a clamp portion for sealing the seal of the cap against the vessel opening in a second seal stage.

18. The method of claim 17 wherein the clamp portion is arranged to allow gas release from the vessel while the cap is retained by the protrusions on the vessel in a first unseal stage prior to removing the cap from the vessel in a second unseal stage.

* * * * *